US010787185B2

(12) United States Patent
Dausoa

(10) Patent No.: US 10,787,185 B2
(45) Date of Patent: Sep. 29, 2020

(54) METHOD FOR CONTROLLING THE HEIGHT OF A TRANSPORT VEHICLE AND RELATED TRANSPORT VEHICLE

(71) Applicant: ALSTOM Transport Technologies, Saint Ouen (FR)

(72) Inventor: Sacheen Dausoa, Le Creusot (FR)

(73) Assignee: ALSTOM TRANSPORT TECHNOLOGIES, Saint Ouen (FR)

( * ) Notice: Subject to any disclaimer, the term of this patent is extended or adjusted under 35 U.S.C. 154(b) by 488 days.

(21) Appl. No.: 15/636,280

(22) Filed: Jun. 28, 2017

(65) Prior Publication Data

US 2018/0001914 A1 Jan. 4, 2018

(30) Foreign Application Priority Data

Jun. 29, 2016 (FR) ..... 16 56120

(51) Int. Cl.
*B61F 5/00* (2006.01)
*B61F 5/02* (2006.01)
*B61F 1/14* (2006.01)

(52) U.S. Cl.
CPC ..... *B61F 5/00* (2013.01); *B61F 1/14* (2013.01); *B61F 5/02* (2013.01)

(58) Field of Classification Search
CPC ..... B61F 5/00; B61F 1/14; B61F 5/02
USPC ..... 702/79; 701/37, 19
See application file for complete search history.

(56) References Cited

U.S. PATENT DOCUMENTS 4,798,369 A 1/1989 Geno et al.
5,447,325 A * 9/1995 DePue ..... B60G 11/04 280/124.106
6,053,112 A 4/2000 Jones, Jr.
6,550,394 B1 4/2003 Polley
6,556,908 B1 * 4/2003 Lu ..... B60G 17/0185 180/271
2004/0016361 A1 1/2004 Teichmann et al.
2015/0353104 A1 * 12/2015 Maeyama ..... B61B 13/00 701/19
2017/0015371 A1 * 1/2017 Strong ..... B62D 53/062
(Continued)

FOREIGN PATENT DOCUMENTS

DE 196 47 998 A1 5/1998
DE 102 36 245 A1 2/2004
DE 102 36 246 A1 6/2005
(Continued)

OTHER PUBLICATIONS

French Search Report, dated Feb. 15, 2017, from corresponding FR application No. 1656120.

*Primary Examiner* — Eman A Alkafawi
(74) *Attorney, Agent, or Firm* — Nixon & Vanderhye

(57) ABSTRACT

Disclosed is a method for controlling the position relatively to a platform of a floor of a carriage including a bogie including a chassis, a primary suspension, and a secondary suspension, the method including the steps: measuring the height of the secondary suspension; and adjusting the height of the secondary suspension, according to the height of the platform for positioning the floor at the height of the platform. This method includes a step for estimating the height of the top of the chassis, the adjustment of the height of the secondary suspension being achieved according to the estimated height of the top of the chassis.

10 Claims, 3 Drawing Sheets

(56) References Cited

U.S. PATENT DOCUMENTS

2017/0158210 A1* 6/2017 Katahira ..... B60G 3/20

FOREIGN PATENT DOCUMENTS

| | | | |
|---|---|---|---|
| EP | 1 391 331 | A2 | 2/2004 |
| FR | 2 878 192 | A1 | 5/2006 |
| JP | 2001-322546 | A | 11/2001 |
| WO | 99/17975 | A1 | 4/1999 |
| WO | 2011/066114 | A2 | 6/2011 |
| WO | 2012/115927 | A1 | 8/2012 |

* cited by examiner

METHOD FOR CONTROLLING THE HEIGHT OF A TRANSPORT VEHICLE AND RELATED TRANSPORT VEHICLE

The present invention relates to a method for controlling the position of a floor of a carriage of a railway vehicle running on rails, relatively to a platform, the carriage comprising a body and at least a bogie, the bogie including an axle, a bogie chassis, at least one primary suspension interposed between the axle and the bogie chassis, and at least one secondary suspension interposed between the primary suspension and the floor, the axle comprising wheels connected through a shaft, the method including the following steps:

measurement of the height of the secondary suspension defined from the top of the bogie chassis, and adjustment of the height of the secondary suspension, according to the height of the platform defined from the top of the rails in order to position the floor at the height of the platform.

BACKGROUND OF THE INVENTION

In the sector of railway transport of travelers, a vehicle is caused to perform several stops in stations, or railway stations, in order to allow the exit or the entry of travelers.

The access of the travelers to a carriage operates at the level of the flooring of the carriage which is found globally positioned facing the platform of the station.

However, the difference in heights, which may exist between the floor and the platform may prove to be unacceptable for certain users, notably those said to be with reduced mobility. In particular, the ADA standard, for American Disability Act, imposes a height difference between the platform and the lower floor of 16 mm. The problem of adapting the height of the floor to platform heights is further posed, which may vary from one station to another.

Document DE 10 236 246 B4 proposes a solution for adjusting the height of the floor, so that it is found at the same height as that of the platform.

This solution is however unsatisfactory. Indeed, the height of the access floor is subject to notable variations, under the effect of various parameters. Mention may notably be made of the value of the load of the corresponding carriage notably to the mass of the passengers and of the luggage occupying the carriage, the distribution of this load, or further the wear of the wheels. In particular, such a solution does not give the possibility of observing the ADA standard.

SUMMARY OF THE INVENTION

An object of the invention is therefore to propose a method allowing simple modifications of the height of a transport vehicle, notably for ensuring easy access to the users of this vehicle, during its different stops in stations.

For this purpose, the object of the invention is a method for controlling the height of a transport vehicle of the aforementioned type, comprising a step for estimating the height of the top of the bogie chassis defined from the shaft of the axle, the adjustment of the height of the secondary suspension being achieved depending on the estimated height of the top of the bogie chassis defined from the shaft.

According to particular embodiments, the method includes one or several of the following features:

the step for estimating the height of the top of the bogie chassis comprises a step for estimating the height of the primary suspension defined from de the shaft of the axle;

the step for estimating the height of the primary suspension comprises the following steps: calculating the flexure under load of the primary suspension, and calculation of the height of the primary suspension defined from the shaft of the axle, this calculation comprises the subtraction of a characteristic parameter of the primary suspension bye the flexure under load calculated from the primary suspension;

the characteristic parameter of the primary suspension is equal to the height defined from the shaft of the primary suspension for a reference load on the body;

the step for estimating the height of the primary suspension defined from the shaft of the axle comprises a step for measuring a load exerted by the body on the bogie, the flexure under load of the primary suspension being equal to the ratio of the sum of the load exerted by the body, measured on the bogie and with a predetermined mass between the primary and secondary suspensions, over the stiffness of the primary suspension;

the secondary suspension comprises at least one pneumatic cushion and a load sensor able to apply the step for measuring the load, the load sensor being able to measure the pressure of each pneumatic cushion of the secondary suspension;

the method comprises a step for estimating the height of the shaft of the axle defined from the top of the rails, the adjustment of the height of the secondary suspension being achieved according of the estimated height of the shaft defined from the top of the rails;

the step for estimating the height of the shaft of the axle defined from the top of the rails comprises the following steps: estimation of the theoretical wear of the wheels, and calculation of the height of the shaft defined from the top of the rails, this calculation comprising the subtraction of a characteristic parameter of the axle by a theoretical decrease in the height of the shaft associated with the theoretical wear of the wheels; and the vehicle has received at least one control operation, the characteristic parameter of the axle being equal to the height of the shaft defined from the top of the rails measured at the end of this control operation.

The invention relates, according to a second aspect, to a transport vehicle comprising at least one carriage comprising a floor, a body and at least one bogie, the bogie including an axle, a bogie chassis, at least one primary suspension interposed between the axle and the bogie chassis, and at least one secondary suspension interposed between the primary suspension and the floor, the axle comprising wheels connected through a shaft, the vehicle being able to control the position, relatively to a platform, of the floor of the carriage, according to a method as defined above.

BRIEF DESCRIPTION OF THE DRAWINGS

The invention will be better understood upon reading the description which follows, given as an example and made with reference to the appended drawings, wherein.

DETAILED DESCRIPTION OF THE PREFERRED EMBODIMENTS

Figure 1:
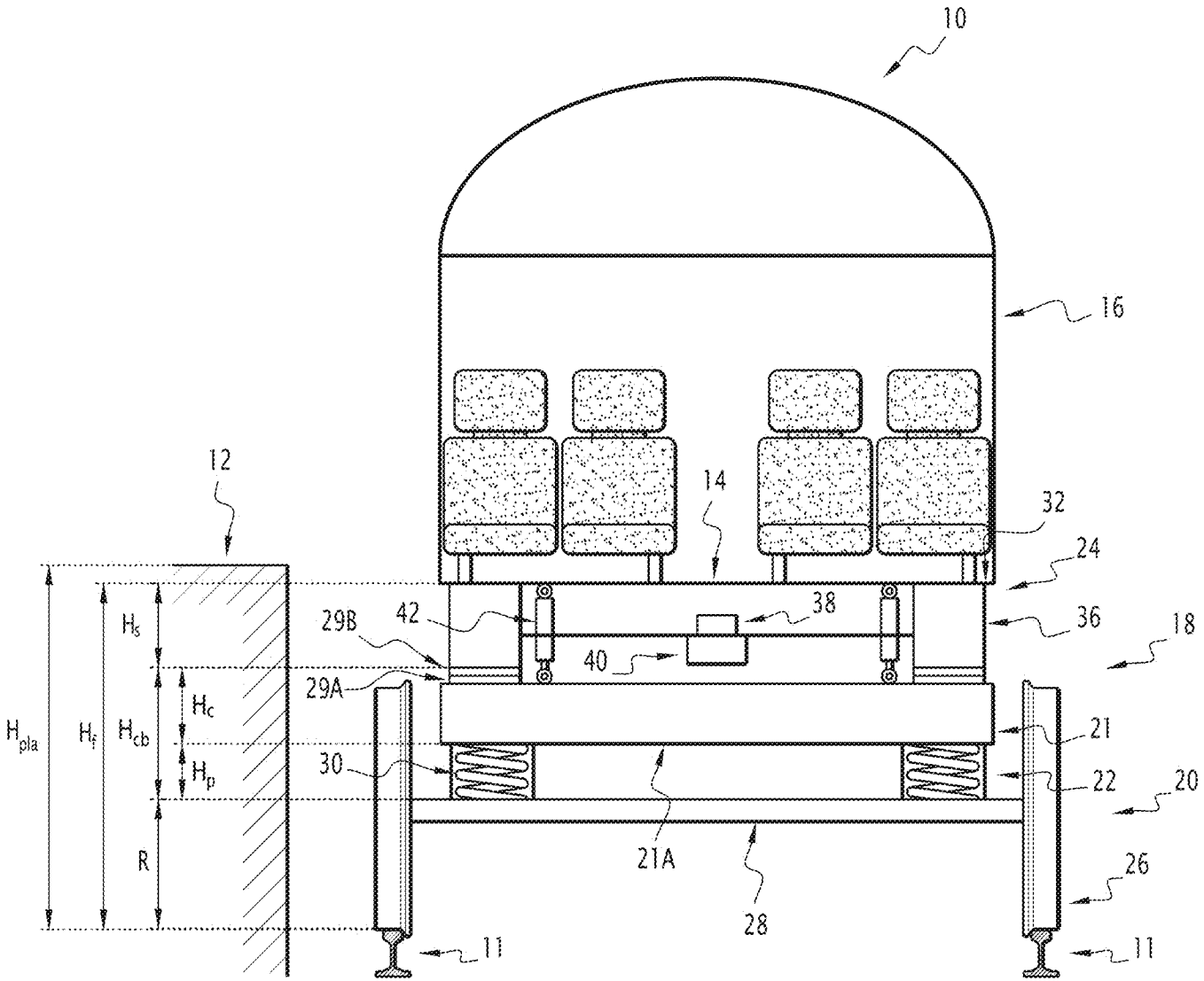
FIG. 1 is a simplified view, a sectional view, of a vehicle carriage according to the invention.
Figure 2:
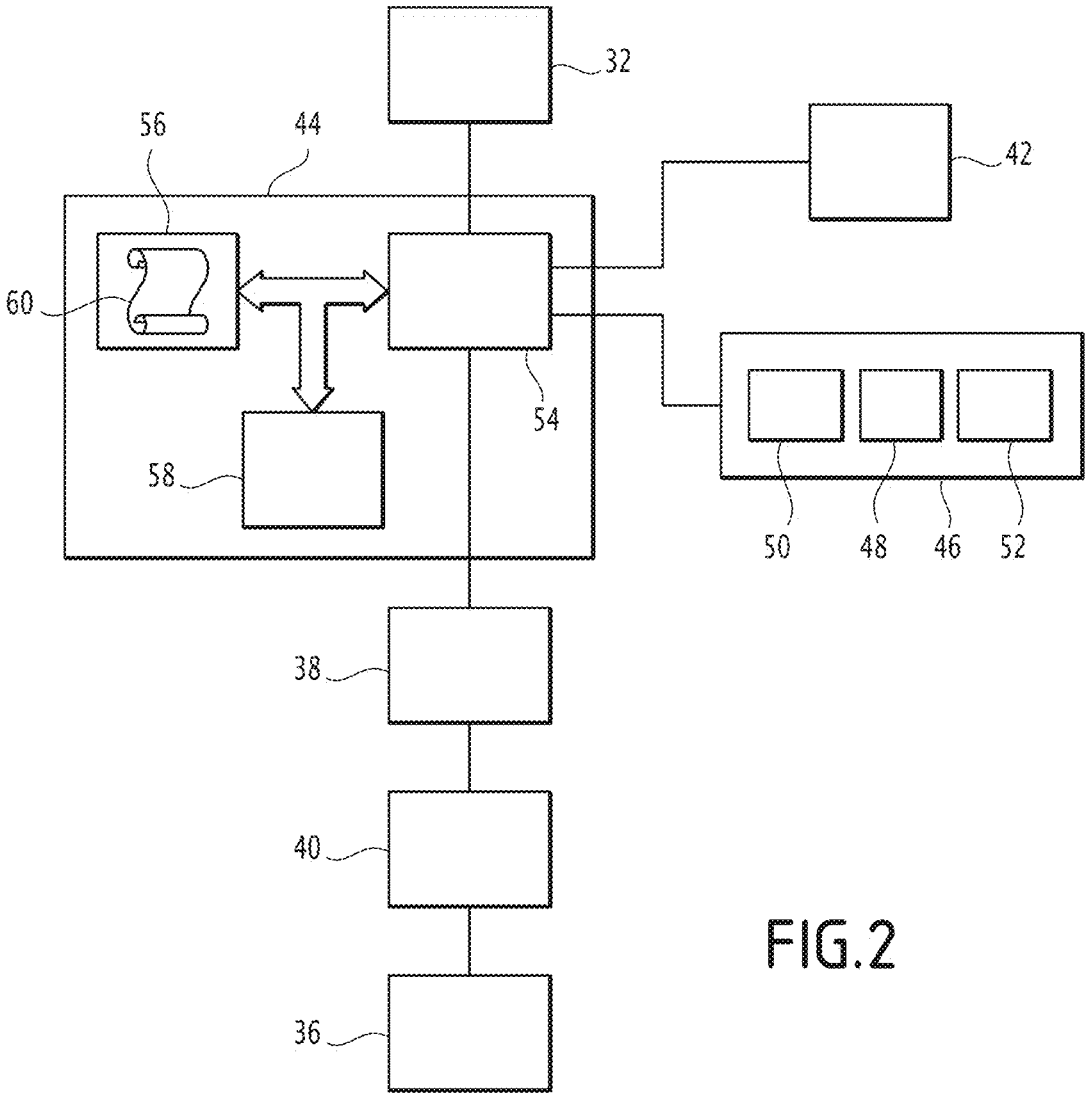
FIG. 2 is a partial schematic view of a vehicle.

A carriage 10 of a transport vehicle for travelers is illustrated, as a section, in a simplified way in FIG. 1. A partial diagram of the carriage 10 is illustrated in FIG. 2.

Such a transport vehicle is for example, a bus, a trolley-bus, a tramway, a metro, a train or any other type of railway vehicle. The vehicle is able to stop at a station including a platform 12. The platform 12 has a height $H_{pla}$, defined from the top of the rails 11 on which circulates the vehicle.

The carriage 10 comprises a floor 14 for access of the travelers to a body 16 and at least one bogie 18. Advantageously, the vehicle includes several carriages 10 and several bogies 18 distributed along the vehicle. For example, each carriage 10 comprises two bogies 18.

The bogie 18 comprises an axle 20, a bogie chassis 21, at least one primary suspension 22 interposed between the axle 20 and the bogie chassis 21, and at least one secondary suspension 24 interposed between the primary suspension 22 and the floor 14. For example and as illustrated in FIG. 1, the bogie 18 comprises two primary suspensions 22 and two secondary suspensions 24.

The axle 20 is movable in rotation relatively to the bogie chassis 21 along an axis substantially parallel to the ground, the axis being transverse to the rails 11. The axle 20 includes two wheels 26 and a shaft 28 connecting the wheels 26.

The wheels 26 are for example solid wheels intended to cooperate with rails 11, or wheels equipped with tires. In the embodiment of the figures, the wheels 26 of the vehicle are solid wheels.

The shaft 28 of the axle 20 has a height R defined from of the rails 11. More specifically, the relevant height is for example the height of the upper portion of the shaft 28 defined from the top of the rails 11. This height R depends on the characteristics of the wheels 26.

Indeed, the wheels 26 exhibit wear which depends on the number of kilometers covered by the vehicle. This wear deforms the wheels 26 in a non-uniform way which reduces the adherence and therefore the safety of the passengers. In order to find a remedy to this problem, from a given mileage, the vehicle is usually conducted into a maintenance center where control operations are conducted on the vehicle. These control operations are for example maintenance operations. The vehicle is advantageously caused to receive several times these control operations during its lifetime. It should be noted that the components of the vehicle have received a first control operation during their building.

In the case when the wheels 26 are equipped with tires, depending on the state of degradation of the tires, these control operations may comprise the replacement of the tires.

In the case when the wheels 26 are solid wheels intended to cooperate with rails 11, these control operations for example, comprise an operation for re-profiling the wheels 26, during which the wheels 26 are machined in order to give them back a standardized shape.

During this re-profiling operation, each wheel has a material removal with a predetermined thickness. This material removal thickness is optionally different for each wheel of the vehicle, in order to guarantee perfect symmetry between the wheels of a same axle and between the different axles of the vehicle.

At each re-profiling operation, the shaft 28 of the axle 20 thus looses height. The total height lost by the shaft 28 during all the re-profiling operations conducted on the wheels 26 since the building of the wheels 26 is noted as $\Delta_{repro}$.

The wear of the wheels 26 since the last re-profiling operation also involves an actual decrease $\Delta_{wear}$ of the height of the shaft 28.

Thus, the height R of the shaft 28 from the top of the rails 11 depends, between other factors:

on the rated construction height $R_n$ of the shaft 28 defined from the top of the rails 11, on the decrease in height $\Delta_{wear/total}$ associated with the wear between the date of building of the wheels 26 and the date of the last re-profiling operation, on the lost height $\Delta_{repro}$ during all the re-profiling operations conducted on the wheels 26, and on the actual decrease in height $\Delta_{wear}$ associated with wear since the last re-profiling operation conducted on the wheels 26. In the case when the wheels 26 have not been subject to any re-profiling operation, this actual decrease $\Delta_{wear}$ is associated with wear since the building of the wheels 26.

For example, the height R of the shaft 28 defined from the top of the rails 11 is equal to $R=R_0-\Delta_{wear}$, wherein $R_0$ is a characteristic parameter of the axle. The characteristic parameter $R_0$ is for example equal to the height of the shaft 28 defined from the top of the rails 11 measured at the end of the last control operation. This height is advantageously measured by an operator at the end of each control operation.

Alternatively, the vehicle comprises a specific traction/braking piece of software, when it is executed, for calculating the diameter of the wheels of each axle from of the measured speed of this axle and thus calculating the height R.

In the case when the wheels 26 have not yet been subject to a re-profiling operation, the parameter $R_0$ is therefore for example equal to $R_0=R_n$.

In the case when the wheels 26 have been subject to re-profiling operations, the parameter $R_0$ is for example equal to $R_0=R_n-\Delta_{repro}-\Delta_{wear/total}$.

For a same axle 20 and after each re-profiling operation, the material removals are optionally compensated by adding shims for compensating for the re-profiling 29A of thickness $\Delta_{shims/repro}$. Advantageously, these shims for compensating for the re-profiling 29A also compensate for the wear of the wheels 26 ascertained between two re-profiling operations.

The thickness of the shims for compensating for re-profiling 29A $\Delta_{shim/repro}$ is for example equal to the sum of the total height lost by the shaft 28 during all the re-profiling operations undergone by the wheels 26, and the lost height by the shaft 28 associated with the wear of the wheels 26 ascertained between each re-profiling operation since the building of the wheels 26.

The shims for compensating for the re-profiling 29A are placed, for example under the secondary suspension 24 and on the bogie chassis 21. The bogie chassis 21 then comprises the shims for compensating for the re-profiling 29A.

The control operations also comprise for example an estimation of the creep $\Delta_{creep}$ of the primary suspension 22. This is notably the case when the primary suspension 22 comprises elements in an elastomeric material.

The creep is then evaluated by an operator and optionally compensated by adding shims for compensating for the creep 29B with thickness $\Delta_{shims/creep}$.

Advantageously, the thickness $\Delta_{shims/creep}$ of the shims for compensating for the creep 29B is equal to the creep $\Delta_{creep}$.

The shims for compensating for the creep 29B are placed for example under the secondary suspension 24 and on the bogie chassis 21. The bogie chassis 21 then comprises the shims for compensating for the creep 29B.

The bogie chassis 21 comprises a crossbar 21A which lies on the primary suspension 22. The top of the bogie chassis 21 is defined as the upper wall of the crossbar 21A at right angles to the primary suspension 22.

At right angles to the primary suspension 22, the bogie chassis 21 has a thickness $H_c$. This thickness $H_c$ is for example equal to the rated construction thickness $H_{cn}$, of the bogie chassis 21 measured at right angles to the primary suspension 22.

The bogie chassis 21 includes for example, other components like tearing shims (not shown). The thickness of these components, in particular of these tearing shims, is then added to the rated building thickness $H_{cn}$ in the value of the height $H_c$ of the bogie chassis 21.

The primary suspension 22 includes dampers not shown and springs 30 to be selected from the group comprising: pneumatic springs or metal springs. Advantageously, the springs 30 have the same stiffness K and are placed between the axle 20 and the bogie 18. Through the springs 30, the primary suspension 22 then has a stiffness K.

As illustrated in FIG. 1, the secondary suspension 24 extends from the top of the bogie chassis 21.

The secondary suspension 24 for example includes at least one, or even several pneumatic cushion(s) 36, a device 38 for actuating the secondary suspension 14, a compressed air tank 40 and a height sensor 42.

The actuation device 38 is able to control the adjustment of the height of the secondary suspension 24. More specifically, the actuation device 38 is configured for increasing or decreasing the pressure in the pneumatic cushion(s) 36, by controlling the arrival of compressed air from the tank 40. The pressure variation in the pneumatic cushion(s) 36 modifies the height of the secondary suspension 24.

The actuation device 38 is advantageously a solenoid valve.

The secondary suspension 24 advantageously comprises a load sensor 32. The load sensor 32 is able to measure the load, noted as P, exerted by the body 16 on the bogie 18. The load P notably depends on the mass of the passengers and of the luggage occupying the body 16.

The load sensor 32 is for example able to measure the pressure of the pneumatic cushions 36.

From these measurements, the load sensor 32 is able to infer therefrom a measurement of the load P exerted by the body 16 on the bogie 18.

The secondary suspension 24 advantageously includes an average vane valve intended to control the braking force of the vehicle. Advantageously, this average vane valve is then the load sensor 32.

The primary suspension 22 exhibits a flexure under load equal to the ratio of the load Q on the primary suspension by the stiffness K of the springs 30. The load Q on the primary suspension is equal to the sum of the measured load P and of the suspended mass between the primary and secondary suspension stages. The suspended mass between the primary and secondary suspension stages has a predetermined value which depends on the configuration of the bogie.

The primary suspension 22 thus has a height $H_p$ defined from the shaft 28 of the axle 20.

For example, the height $H_p$ of the primary suspension 22 defined from of the shaft 28 is equal to $H_p=H_{p0}-Q/K$, wherein $H_{p0}$ is a characteristic parameter of the primary suspension 22.

The characteristic parameter $H_o$ depends on the rated building height $H_{pn}$, of the primary suspension 22 defined from of the shaft 28, from the load P exerted by the body 16 on the bogie 18, from the stiffness K of the primary suspension 22 and from the creep $\Delta_{creep}$ of the suspension.

In particular, the characteristic parameter $H_{p0}$ is for example equal to the height of the primary suspension 22 defined from the shaft 28 for a reference load on the body 16, for example, when the body 16 is without any passengers, i.e. when the body 16 is with zero load. This height is advantageously measured by an operator at the end of each control operation.

Thus, the characteristic parameter $H_{p0}$ is for example equal to $H_{p0}=H_{pn}-\Delta_{creep}$.

The primary suspension 22 for example includes other components like tearing shims (not shown) intended to compensate for the manufacturing tolerances in the elements of the vehicle. The thickness of these components, in particular these tearing shims, is then added in the expression of the parameter $H_{p0}$.

The height of the top of the bogie chassis 21 is designated by $H_{cb}$ defined from the shaft 28. This height $H_{cb}$ then depends on the height $H_c$ of the bogie chassis 21 measured at right angles of the primary suspension 22, of the height $H_p$ of the primary suspension 22 defined from of the shaft 28, and optionally from the thickness $\Delta_{shims/repro}$ of the shims for compensating for the re-profiling 29A and/or of the thickness $\Delta_{shims/creep}$ of the shims for compensating for creep 29B.

In the case when the wheels 26 have not undergone any re-profiling operation, and the primary suspension 22 has not undergone any operation for estimating creep, the height $H_{cb}$ is for example equal to $H_{cb}=H_c+H_p$.

In the case when the wheels 26 have undergone re-profiling operations, but the primary suspension 22 has not undergone any creep estimation operation, the height $H_{cb}$ is for example equal to $H_{cb}=H_c+H_p+\Delta_{shims/repro}$.

In the case when the wheels 26 have not undergone any re-profiling operation, but the primary suspension 22 has undergone creep estimation operations, the height $H_{cb}$ is for example equal to $H_{cb}=H_c+H_p+\Delta_{shims/creep}$.

Finally, in the general case when the wheels 26 have undergone re-profiling operations, and the primary suspension 22 has undergone creep estimation operations, the height $H_{cb}$ is for example equal to $H_{cb}=H_c+H_p+\Delta_{shims/repro}+\Delta_{shims/creep}$.

The secondary suspension 24 has a height $H_s$ defined from the top of the bogie chassis 21. The height sensor 42 is specific for measurement of this height $H_s$.

The floor 14 has, at the bogie 18, a height $H_f$ defined from the top of the rails 11.

The height $H_f$ of the floor 14 depends on the height R of the shaft 28 of the axle 20 defined from the top of the rails 11, on the height $H_{cb}$ of the top of the bogie chassis 21 defined from the shaft 28, and on the height $H_s$ of the secondary suspension 24 defined from the top of the bogie chassis 21.

The height $H_f$ also depends on a geometrical constant $H_{f0}$ depending on the geometry and on the dimensions of the carriage 10. The constant $H_{f0}$ is thus for example equal to the height of the floor 14 measured at right angles to the secondary suspension 24.

More specifically, the height $H_f$ is equal to $H_f=R+H_{cb}+H_s+H_{f0}$.

The vehicle comprises a processing unit 44 and an odometer 46.

The odometer 46 is able to calculate the number of covered kilometers by the vehicle between two predetermined dates. The predetermined dates are for example the date of the last control operation and the current date.

For this, the odometer 46 for example comprises a processor 48 able to handle the operation of the odometer 46, a memory 50 able to store the number of covered kilometers between both predetermined dates, and a geolocalization system 52, for example of the GPS (Global Positioning System) type. The processor 48 is then connected to the memory 50 and to the geolocalization system 52.

The processing unit 44 is connected to the odometer 46, to the load sensor 32, to the displacement sensor 42 and to the actuation device 38 of the secondary suspension 24 of each bogie 18 of each carriage 10 of the vehicle.

The processing unit 44 includes a processor 54 connected to a memory 56 and to a graphic interface 58.

The memory 56 is able to store the known values of the characteristics of the platform 12 and of the vehicle. In a non-exhaustive way, these characteristics are for example:

the height $H_{pla}$ of the platform 12 defined from the top of the rails 11, the characteristic parameter $R_0$, i.e. the height of the shaft 28 defined from the top of the rails 11 measured at the end of the last control operation, for each bogie 18 of each carriage 10, the rated building height $R_n$ of the shaft 28 of the axle 20 defined from the top of the rails 11, for each bogie 18 of each carriage 10, the height $\Delta_{repro}$ lost by the axle 20 during all the re-profiling operations, for each bogie 18 of each carriage 10, if the vehicle 10 has undergone such operations, the decrease in height $\Delta_{wear/total}$ associated with wear between the building date of the wheels 26 and the date of the last re-profiling operation, for each bogie 18 of each carriage 10, the characteristic parameter $H_{p0}$, i.e. the height of the primary suspension 22 defined from the shaft 28 when the body 16 is without any travelers, for each bogie 18 of each carriage 10, the rated building height $H_{pn}$, of each primary suspension 22 defined from the shaft 28, for each bogie 18 of each carriage 10, the height $H_c$ of the bogie chassis 21 measured at right angles to each primary suspension 22, for each bogie 18 of each carriage 10, the thickness $\Delta_{shims/repro}$ of the shims for compensating for the re-profiling 29A, for each bogie 18 of each carriage 10, if the vehicle 10 has undergone a re-profiling operation, the creep $\Delta_{creep}$ of the primary suspension 22, for each bogie 18 of each carriage 10, if the vehicle 10 has undergone a creep estimation operation, the thickness $\Delta_{shims/creep}$ of the shims for compensating for the creep 29B, for each bogie 18 of each carriage 10, if the vehicle 10 has undergone a creep estimation operation, the stiffness K of each primary suspension 22, for each bogie 18 of each carriage 10, the suspended mass between the primary and secondary suspension stages, the thickness of optional tearing shims of the bogie chassis 21 and/or of each primary suspension 22, for each bogie 18 of each carriage 10, and the geometrical constant $H_{f0}$, at each bogie 18 of each carriage 10.

The memory 56 is also able to store the number of kilometres covered by the vehicle between both predetermined dates.

For example, the graphic interface 58 is configured for allowing an operator to store in the memory 56 the known values of the preceding characteristics.

The memory 56 comprises a program 60. The program 60 is able to handle the steps of the method for controlling the position of the floor 14 of the carriage 10 of the vehicle, the processor 54 being able to perform the calculations.

The processor 54 is able to estimate the height R of the shaft 28 defined from the top of the rails 11.

Advantageously, the processor 54 is able to take into account the wear of the wheels 26 in its calculation of the height R of the shaft 28 defined from the top of the rails 11.

For this, the processor 54 is able to calculate, from data from the odometer 46, theoretical wear of the wheels according to the number of kilometres covered by the vehicle.

Alternatively, the memory 56 comprises a specific traction/braking piece of software able to calculate the diameter of the wheels of each axle from the measured speed of this axle.

The processor 54 is then able to infer therefrom a theoretical reduction $\Delta_{wear/theo}$ of the height of the shaft 28 associated with the wear. Advantageously, this theoretical reduction $\Delta_{wear/theo}$ is equal to the actual reduction $\Delta_{wear}$.

The processor 54 is also able to calculate the heights $H_p$, $H_{cb}$, $H_s$ and $H_f$ from the preceding formulae, and to estimate the difference between the height $H_{pla}$ of the platform 12 and the height $H_f$ of the floor 14.

For the calculation of the height $H_p$, in the case when the primary suspension 22 has undergone a creep estimation operation, the processor 54 is able to calculate the height $H_p$ by assigning to the creep $\Delta_{creep}$, the estimated value at the creep estimation operation. More specifically, the characteristic parameter $H_{p0}$ is then for example considered to be equal to $H_{p0}=H_{pn}-\Delta_{creep}$.

In the case when the primary suspension 22 has not undergone a creep estimation operation, the processor 54 is configured for assigning the creep a zero value. More specifically, the characteristic parameter $H_{p0}$ is then for example considered as equal to $H_{p0}=H_{pn}$.

The processor 54 is then able to control the device 38 for actuating the secondary suspension 24, so that the difference between the height $H_{pla}$ of the platform 12 and the height $H_f$ of the floor 14 is comprised between −16 mm and 16 mm, advantageously so as to cancel out this difference.

Figure 3:
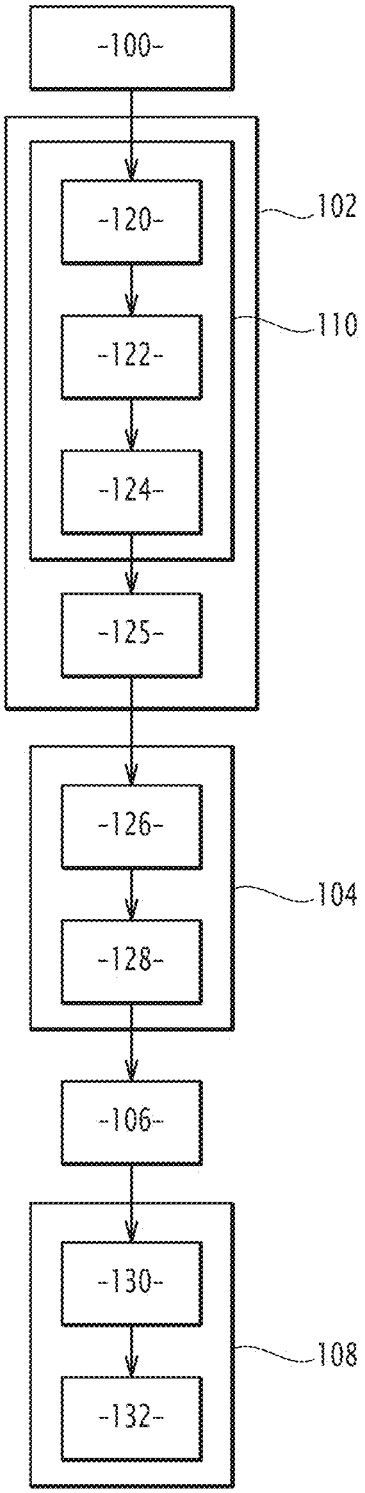
FIG. 3 is a flow chart of a method for controlling the height of a vehicle according to the invention.

A method for controlling the position of the floor of a carriage of a vehicle will now be described with reference to FIG. 3.

The method is applied for each bogie of each carriage of the vehicle.

The method includes a step 100 for parameterizing the processing unit 44, a step 102 for estimating the height of the top of the bogie chassis 21 followed by a step 104 for estimating the height of the shaft 28 of the axle 20, a step 106 for measuring the height of the secondary suspension 24 and a step 108 for adjusting the height of the secondary suspension 24 according to the height of the platform 12 for positioning the floor at the height of the platform 12.

During the preliminary step 100 for parameterization, an operator measures and stores the known values of the preceding characteristics of the platform 12 and of the vehicle, in the memory 56 of the processing unit 44.

The step 102 for estimating the height of the top of the bogie chassis 21 comprises a step 110 for estimating the height of the primary suspension 22.

The step 110 for estimating the height of the primary suspension 22 comprises a step 120 for measuring the load of the body 16 on the bogie 18, during which the load sensor 32 measures the load P of the body 16 on the bogie 18.

The load sensor 32 for example measures the pressure of the pneumatic cushions 36 and infers therefrom a measurement of the load P.

The step 110 for estimating the height of the primary suspension 22 then includes a step 122 for calculating the flexure under load of the primary suspension 22.

During this step 122 for calculating the flexure under load of the primary suspension 22, the processor 54 calculates the flexure under load of the primary suspension 22, from the measurement of the load P carried out in step 120 for measuring the load, of the mass between the primary and secondary suspension stage and of the stiffness stored in memory by the memory 56. More specifically, the processor 54 performs the sum of the measured load P and of the mass between the primary and secondary suspension stages and divides this sum by the stiffness K of the primary suspension 22. The stiffness K is for example equal to the stiffness of the springs 30.

The step 110 for estimating the height of the primary suspension 22 then comprises a step 124 for calculating the height $H_p$ of the primary suspension 22 defined from the shaft 28.

During this step 124 for calculating the height of the primary suspension 22, the processor 54 uses the calculation carried out in step 122 for calculating the flexure under load of the preceding primary suspension 22 for inferring therefrom the height $H_p$ of the primary suspension 22 defined from the shaft 28. More specifically, the processor 54 subtracts the characteristic parameter $H_{p0}$ of the primary suspension 22 from the flexure calculated in step 122 for calculating the flexure under load of the primary suspension 22.

The step 102 or estimating the height the top of the bogie chassis 21, comprises a step 125 for calculating the height of the bogie chassis 21.

During this step 125 for calculating the height of the bogie chassis 21, the processor 54 assigns to the height $H_{cb}$ of the top of the bogie chassis 21 defined from the shaft 28, the sum of the height $H_p$ of the primary suspension 22, of the thickness $H_c$ of the bogie chassis 21, and optionally the thickness $\Delta_{shims/repro}$ of the shims for compensating for the re-profiling 29A and/or of the thickness $\Delta_{shims/creep}$ of the shims for compensating for creep 29B. The thicknesses of the shims are added if the shims are present in the bogie 18.

The step 104 for estimating the height of the shaft 28 of the axle 20 advantageously includes a step 126 for estimating the theoretical wear of the wheels 26 according to the mileage.

During this step 126 for estimating the theoretical wear, the processor 54 collects the number of kilometers covered by the vehicle since the last control operation, from the odometer 46 or from the memory 56. The processor 54 then calculates the theoretical reduction $\Delta_{wear/theo}$ of the height of the shaft 28 associated with wear. Alternatively, the processor 54 recovers the diameter of the wheel from the data transmitted by the traction/braking piece of software and infers therefrom the theoretical reduction $\Delta_{wear/theo}$ of the height of the shaft 28.

The step 104 for estimating the height of the shaft 28 then includes a step 128 for calculating the height of the shaft 28, during which the processor 54 calculates the height R of the shaft 28 defined from the top of the rails 11. For example, if the bogie 18 of the carriage 10 has at least undergone one re-profiling operation, the processor 54 assigns to the height R, the result of the following calculation: $R=R_0-\Delta_{wear/theo}$.

During the step 106 for measuring the height of the secondary suspension 24, the height sensor 42 measures the height $H_s$ of the secondary suspension 24 defined from the top of the bogie chassis 21.

The step 108 for adjusting the height of the secondary suspension 24 comprises a first step 130 for calculating the height of the floor 14.

During this step 130 for calculating the height of the floor 14, the processor 54 collects the height $H_s$ of the secondary suspension 24 from the height sensor 42. The processor 54 then calculates the height $H_f$ of the floor 14 defined from the top of the rails 11. More specifically, the processor 54 assigns to the height $H_f$, the result of the following calculation: $H_f=R+H_{cb}+H_s+H_{f0}$.

The step 108 for adjusting the height of the secondary suspension 24 then comprises a step 132 for adjusting the height of the secondary suspension 24.

During this step 132 for adjusting the height of the secondary suspension 24, the processor 54 calculates the difference between the height $H_f$ of the floor 14 defined from the top of the rails 11 and the height $H_{pla}$ of the platform 12 defined from the top of the rails 11.

The processor 54 determines in this way, the height modification which the secondary suspension 24 has to undergo so that the difference is comprised between −16 mm and 16 mm, advantageously so that it is canceled out.

In a station, the processor 54 then elaborates a command and sends it to the actuation device 38. Depending on this command, the device 38 controls the arrival of compressed air from the tank 40 to the pneumatic cushion(s) 36, and thus varies the volume of the pneumatic cushion(s) 36 and therefore the height of the secondary suspension 24.

While rolling, the processor 54 elaborates a command and sends it to the actuation device 38 only when the height of the secondary suspension varies, for example by more than 50 mm based on a reference height of the secondary suspension. The purpose here is to minimize the consumption of air under dynamic conditions.

At the end of stopping (closing of the doors), the secondary suspension is re-shifted towards the reference height in order to be re-centered before the rolling phase.

Thus, the adjustment of the height of the secondary suspension 24 is achieved according to the height of the primary suspension 22 and to the height of the shaft 28 of the axle 20 from the top of the rails 11.

Alternatively, the step 104 for estimating the height of the shaft 28 of the axle 20 is applied before the step 102 for estimating the height of the top of the bogie chassis 21.

According to another alternative, the method does not include any step 104 for estimating the height of the shaft 28 of the axle 20. For the step 130 for calculating the height of the floor 14, the processor 54 then assigns a constant value to the height R of the shaft 28 of the axle 20 defined from the top of the rails 11. This value is advantageously the height $R_0$ of the shaft 28 defined from the top of the rails 11 measured by an operator during the last control operation.

The method described provides a solution for adjusting the height of the floor by taking into account the value of parameters like the load of the vehicle or further the wear of the wheels.

The method thereby allows simple modification of the height of the transport vehicle in order to facilitate access of all the travelers to the body of the vehicle. In particular, the method gives the possibility of observing the ADA standard.

The invention claimed is:

1. A method for controlling the position, relative to a platform, of a floor of a carriage of a railway vehicle moving on rails, where the carriage has a body and at least one bogie, the bogie including an axle, a bogie chassis, at least one primary suspension interposed between the axle and the bogie chassis, and at least one secondary suspension interposed between the primary suspension and the floor, and the axle being comprised of wheels connected through a shaft, the method comprising the following steps:

measuring a height of the secondary suspension, defined as a distance from a top of the bogie chassis to a top of the secondary suspension; and adjusting the height of the secondary suspension, based on a height of the platform defined as a distance from a top of the rails to a level of a surface of the platform, so as to position the floor of the carriage at the level of of the platform, wherein the step of adjusting the height of the secondary suspension includes estimating a height of the top of the bogie chassis, defined as a distance from the shaft of the axle to the top of the bogie chassis.

2. The method according to claim 1, wherein the step of estimating the height of the top of the bogie chassis comprises a step of estimating a height of the primary suspension, defined as a distance from the shaft of the axle to a top of the primary suspension.

3. The method according to claim 2, wherein the step of estimating the height of the primary suspension comprises the following steps:

calculating a flexure under load of the primary suspension, and subtracting a characteristic parameter of the primary suspension from the calculated flexure under load of the primary suspension to thereby yield an estimated height of the primary suspension.

4. The method according to claim 3, wherein the characteristic parameter of the primary suspension is equal to a height defined as a distance from the shaft to the top of the primary suspension, where the primary suspension is subject to a reference load applied to the body of the carriage.

5. The method according to claim 3, wherein the step of estimating the height of the primary suspension comprises a step of measuring a load exerted by the body on the bogie, the flexure under load of the primary suspension being equal to a ratio defined by a sum of the measured load exerted by the body on the bogie and a predetermined mass between the primary and secondary suspensions, divided by a stiffness of the primary suspension.

6. The method according to claim 5, wherein the secondary suspension comprises at least one pneumatic cushion and a load sensor that carries out the step of measuring the load exerted by the body on the bogie, the load sensor configured to measure a pressure of each pneumatic cushion of the secondary suspension.

7. The method according to claim 1, further comprising:

estimating a height of the shaft of the axle defined as a distance from the top of the rails to a top of the axle, the step of adjusting the height of the secondary suspension being achieved according to the estimated height of the shaft.

8. The method according to claim 7, wherein the step of estimating the height of the shaft of the axle comprises:

estimating a theoretical wear of the wheels, and subtracting a characteristic parameter of the axle from a theoretical reduction of a height of the shaft associated with the estimated theoretical wear of the wheels.

9. The method according to claim 8, wherein the characteristic parameter of the axle is the height of the shaft measured at an end of a control operation performed upon the vehicle.

10. A transport vehicle including at least one carriage comprising a floor, a body and at least one bogie, the bogie including an axle, a bogie chassis, at least one primary suspension interposed between the axle and the bogie chassis, and at least one secondary suspension interposed between the primary suspension and the floor, the axle comprising wheels connected through a shaft, the vehicle being able to control the position, relatively to a platform, of the floor of the carriage, according to a method according to claim 1.

* * * * *